US008453951B2

(12) United States Patent
Perry et al.

(10) Patent No.: US 8,453,951 B2
(45) Date of Patent: Jun. 4, 2013

(54) FUEL INJECTOR

(75) Inventors: Robert B. Perry, Leicester, NY (US); Michael Raymond Salemi, Rochester, NY (US); Kevin J. Allen, Avon, NY (US); Kevin Richard Keegan, Hilton, NY (US)

(73) Assignee: Delphi Technologies, Inc., Troy, MI (US)

( * ) Notice: Subject to any disclaimer, the term of this patent is extended or adjusted under 35 U.S.C. 154(b) by 353 days.

(21) Appl. No.: 12/887,695

(22) Filed: Sep. 22, 2010

(65) Prior Publication Data

US 2012/0067982 A1 Mar. 22, 2012

(51) Int. Cl.
*B05B 1/30* (2006.01)

(52) U.S. Cl.
USPC ..... 239/585.3; 239/585.4

(58) Field of Classification Search
USPC ..... 239/585.1, 585.3, 585.4, 585.5, 533.2, 239/533.7, 533.9, 584; 251/129.15, 129.16, 251/129.19
See application file for complete search history.

(56) References Cited

U.S. PATENT DOCUMENTS

| | | | | |
|---|---|---|---|---|
| 3,623,460 | A * | 11/1971 | Komaroff et al. | 123/472 |
| 7,422,166 | B2 * | 9/2008 | Hoffmann et al. | 239/585.2 |
| 7,506,827 | B2 | 3/2009 | Petrone et al. | |
| 2004/0164175 | A1 * | 8/2004 | Maeurer et al. | 239/102.2 |
| 2006/0255185 | A1 * | 11/2006 | Cristiani et al. | 239/533.7 |
| 2007/0095955 | A1 | 5/2007 | Hoffmann et al. | |

OTHER PUBLICATIONS

Brauer, Considering Electromagnetic Delays, Motion System Design,May 11, 2010, http://motionsystemdesign.com/sensing-control/considering-electromagnetic-delays-0909/.
Brauer, Toward the Instant-On Actuator, Machine Design by Engineers for Engineers.com, Jul. 27, 2006, http://machinedesign.com/article/toward-the-instant-on-actuator-0727.
Brauer, Equivalent Resistor for Nonlinear Magnetic Diffusion in Electromechanical and Electrohydraulic Systems Models, Automotive Electromechanical Simulation Workshop, Detroit, MI Oct. 9, 2003.

* cited by examiner

*Primary Examiner* — Davis Hwu
(74) *Attorney, Agent, or Firm* — Lawrence D. Hazelton

(57) ABSTRACT

A fuel injector that includes a sliding armature, decoupled armature, or flying armature movable between a pintle stop and a housing stop. Flying armatures are generally used to increase the total force applied to the pintle stop for lifting the pintle off a nozzle seat to open the fuel injector. When the fuel injector is turned off, a housing stop is arranged to absorb kinetic energy present in the flying armature so that the kinetic energy is not imparted to the nozzle seat.

3 Claims, 3 Drawing Sheets

FUEL INJECTOR

TECHNICAL FIELD OF INVENTION

The invention generally relates to a fuel injector, and more particularly relates to reducing the occurrence of pintle bounce back when the fuel injector is turned off to stop fuel from flowing from the fuel injector.

BACKGROUND OF INVENTION

Many electro-magnetic type fuel injectors are configured such that when a current is applied to a coil winding within the fuel injector, a magnetic field is generated that urges the pintle/ball assembly away from the nozzle seat and thereby turns the injector ON. In general, the amount of force needed to lift a pintle/ball assembly from the injector OFF or closed position to the injector ON or open position is proportional to a pintle return spring force plus a fuel pressure of the fuel present in the injector. However, some direct injection fuel systems have increased fuel pressures to a level where it becomes difficult to provide a fuel injector that has the same physical outline or package size as injectors designed for lower fuel pressure levels, and is able to reliably 'dead lift' the pintle/ball assembly at the higher fuel pressure levels.

It has been proposed to add a sliding armature, also known as a decoupled armature or flying armature, that in response to the magnetic field, accelerates towards and strikes a pintle stop like a slide hammer to provide a combination of kinetic energy and static force to lift the pintle/ball assembly off the nozzle seat. However, the additional mass of this armature undesirably increases the impact force of the pintle/ball assembly on the nozzle seat when the fuel injector is turned OFF, which may lead to the ball bouncing back off the nozzle seat, thereby resulting in unmetered fuel being dispensed, or fuel being dispensed that is not properly atomized. This temporary movement of the pintle/ball away from the seat may also be referred to as pintle bounce. Elimination or reduction of this unmetered fuel may also reduce injector to injector flow variation. The increased impact force may also lead to undesirable noise and/or reduced injector life.

SUMMARY OF THE INVENTION

The invention described herein provides a housing stop to absorb kinetic energy from a sliding armature when a fuel injector is being turned off.

In accordance with one embodiment of this invention, a fuel injector includes a housing, a nozzle seat, a pintle, a pintle stop, a housing stop, and a sliding armature. The housing is configured to direct fuel flow therethrough. The nozzle seat is fixedly coupled to the housing and configured to direct fuel flow from the fuel injector. The pintle is arranged within the housing. The pintle is movable to an open position where the pintle is spaced apart from the nozzle seat such that fuel is dispensed by the fuel injector and a closed position where the pintle contacts the nozzle seat such that no fuel is dispensed by the fuel injector. The pintle stop is fixedly coupled to the pintle. The housing stop is fixedly coupled to the housing. The sliding armature movable between the pintle stop and the housing stop in response to a magnetic field. When the magnetic field is present, the sliding armature contacts the pintle stop and urges the pintle toward the open position. When the magnetic field is not present, the pintle is free to move toward the closed position. The sliding armature is separated from the pintle stop when the sliding armature contacts the housing stop.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

The present invention will now be described, by way of example with reference to the accompanying drawings, in which.

DETAILED DESCRIPTION OF INVENTION

Figure 1:
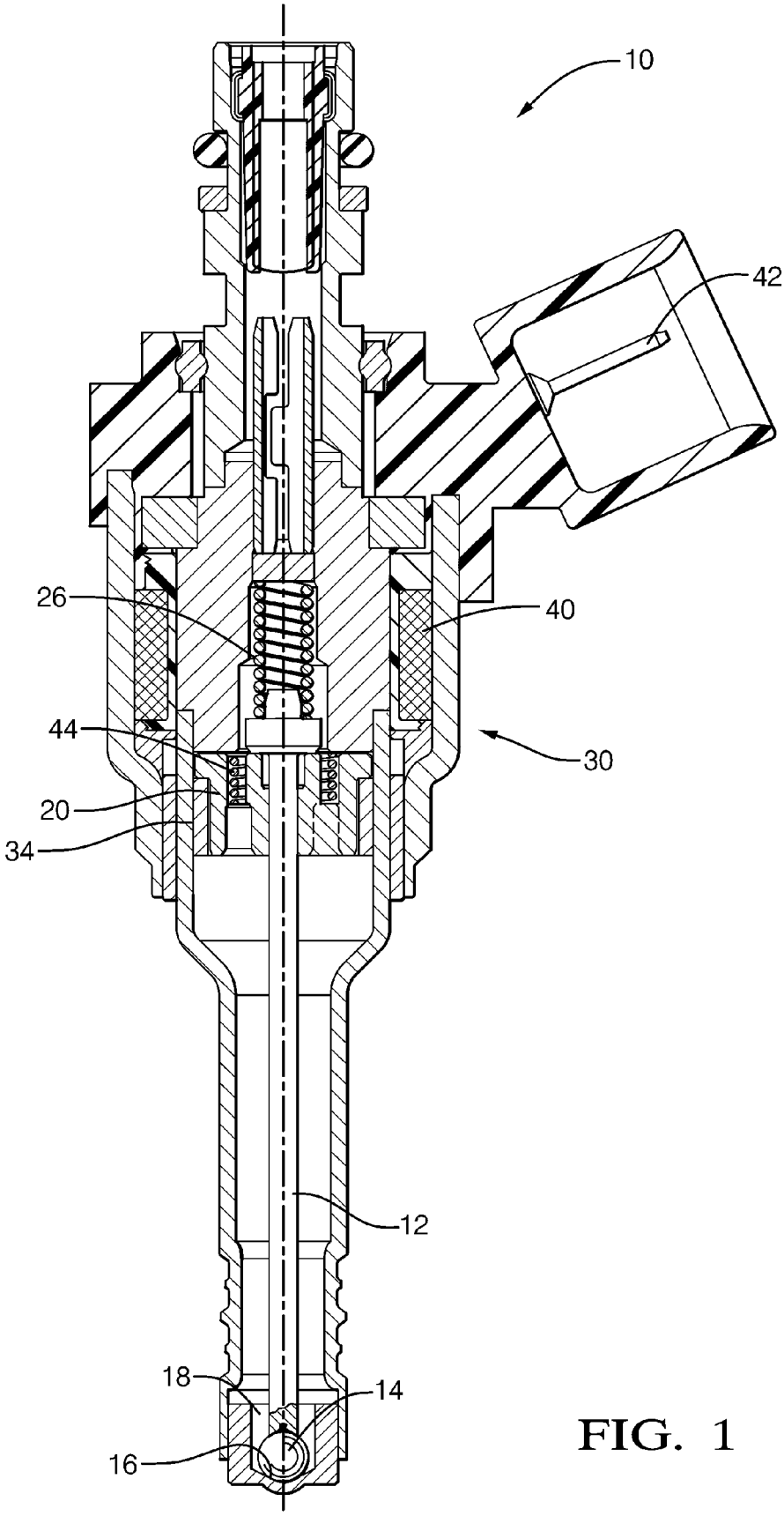
FIG. 1 is cross sectional view of a fuel injector in accordance with one embodiment.
Figure 2A:
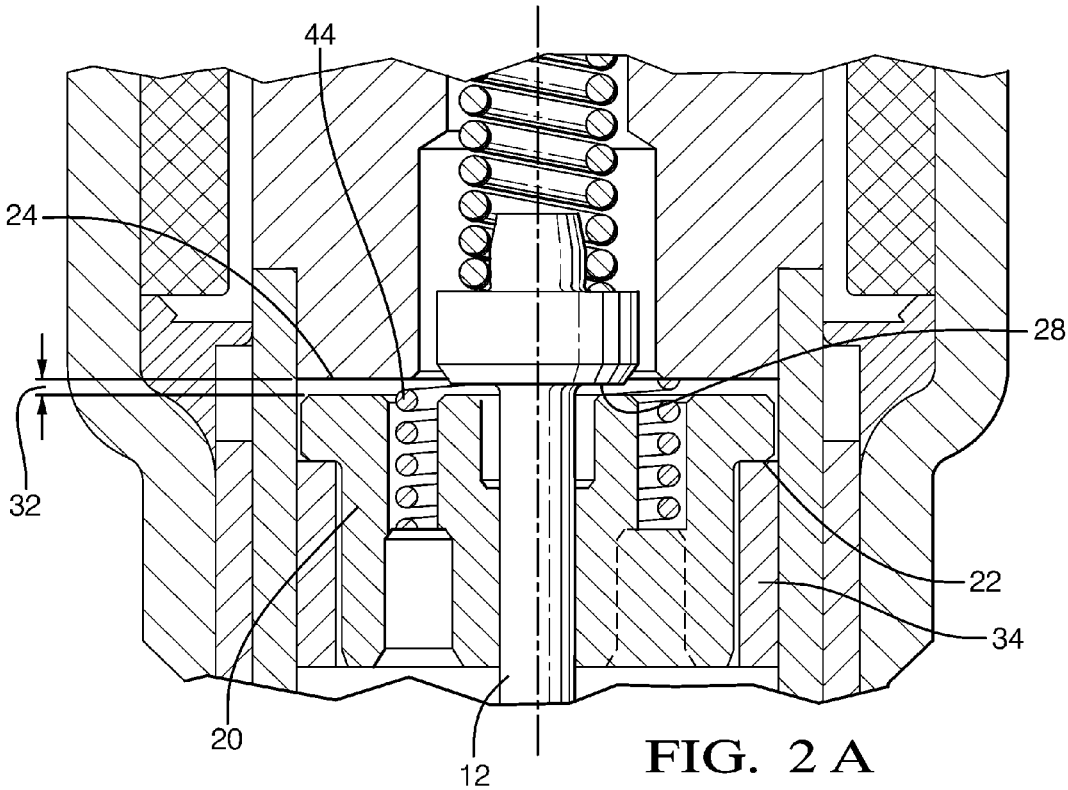
FIG. 2 is a close-up view showing details of the fuel injector in FIG. 1 at different operating conditions.
Figure 2B:
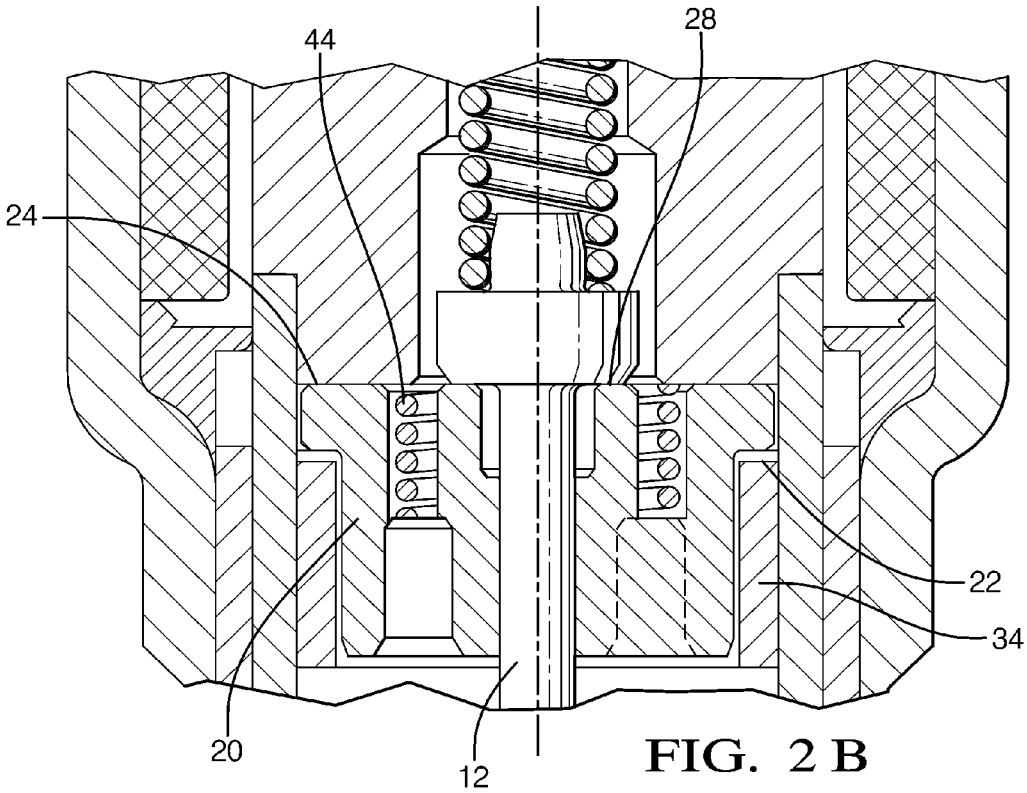

In accordance with an embodiment of a fuel injector for an internal combustion engine, FIGS. 1-2 illustrate a fuel injector 10. In general, the injector 10 has a pintle 12 that may include a ball 14 or other feature configured to cooperate with a nozzle seat 16 to regulate the flow of fuel in cavity 18, hereafter fuel 18, to be dispensed by the injector 10. FIG. 2A shows the pintle 12 after moving into a closed position that positions the ball 14 in contact with the nozzle seat 16 to prevent fuel 18 from flowing out of injector 10. FIG. 2B shows the pintle 12 after moving into an open position so the ball 14 can be apart from the nozzle seat 16 to allow fuel 18 to be dispensed by the fuel injector 10.

The injector 10 may also include a sliding armature 20 movable between a first position against a housing stop 22 as illustrated in FIG. 2A, and a second position against an armature stop 24 as illustrated in FIG. 2B. As will be explained in more detail later, the sliding armature 20 may be urged toward the armature stop 24 by a magnetic field that is generally directed toward or through at least a portion of the sliding armature 20 for moving the sliding armature 20 toward the armature stop 24. The sliding armature 20 may be slideably coupled to the pintle 12 as illustrated in FIGS. 2A and 2B where the sliding armature 20 surrounds a portion of the pintle 12 and slides along that portion. The pintle 12 and the sliding armature 20 may be configured so that the sliding armature 20 contacts a pintle stop 28 as the sliding armature 20 moves from a position near the housing stop 22 toward the armature stop 24. If the sliding armature 20 is being urged toward the armature stop 24, then the contact with the pintle stop 28 will act to urge the pintle 12 toward the open position. When the sliding armature 20 is against the armature stop 24, then the pintle 12 is generally considered to be in the open position. The sliding armature 20 may also be slideably coupled to the pintle 12 such that the pintle 12 is free to move to the closed position when the sliding armature 20 is not in contact with the armature stop 24 and the pintle stop 28 or when the sliding armature 20 is at or near the housing stop 22.

The components described and illustrated as being within the injector 10 are generally enclosed in a housing 30 configured to support the components and direct fuel flow therethrough. The nozzle seat 16 is fixedly coupled to the housing 30 in a manner that seals to prevent fuel leakage and is generally configured to direct fuel flow from the fuel injector 10 in a particular spray pattern. The pintle stop 28 may be provided by a separate piece fixedly coupled to the pintle 12, or may be formed integrally with the pintle 12. Likewise, the housing stop 22 may be provided by a separate part such as a stop ring 34 as illustrated that is fixedly coupled to the housing, or may be a feature integrally formed with the housing 30. The location of the housing stop 22 and the configuration of the stop ring 34 is selected so that the kinetic energy stored in the sliding armature 20 when the sliding armature is moving toward the housing stop 22 is transferred to the housing stop 22 instead of being transferred to the nozzle seat 16 as will be described in more detail below.

The arrangement of the sliding armature 20 and the armature stop 24 may define an air gap 32 having a gap size that depends on the position of the sliding armature 20 relative to the armature stop 24. The housing 30 may also include a coil 40 configured to generate the magnetic field in response to a coil current arising from a voltage being applied to first and second connector pins 42. While FIG. 1 only shows one connector pin, it will be appreciate that at least two electrical connections are necessary to generate current in the coil 40.

When a coil current through the coil 40 arises following the application of a voltage to the coil 40, a magnetic field may be generated that urges the sliding armature 20 toward the armature stop 24. When the sliding armature 20 makes contact with the pintle stop 28, a static force arising from the magnetic field acting on the sliding armature 20 may act on the pintle 12 to urge it to the open position. In addition, when the sliding armature 20 makes contact with the pintle stop 28 while the armature is moving toward the armature stop 24, an impact force arising from the kinetic energy of the sliding armature 20 at the moment of impact with the pintle stop 28 may combine cooperatively with the static force to generate a pintle opening force greater than either the static force or the impact force alone. Such a combination of forces may be effective to overcome a pintle closing force and thereby move the pintle 12 from the closed position to the open position. In other words, following the application of a coil current to the coil 40, the impact of the sliding armature 20 on the pintle stop 28 acts like a slide hammer striking the pintle stop 28 to help overcome the forces holding the pintle 12 in the closed position. Further explanation of is found in U.S. patent application Ser. No. 12/821,475 by Mieney et al, filed Jun. 23, 2010, the entire disclosure of which is hereby incorporated herein by reference.

Figure 3A:
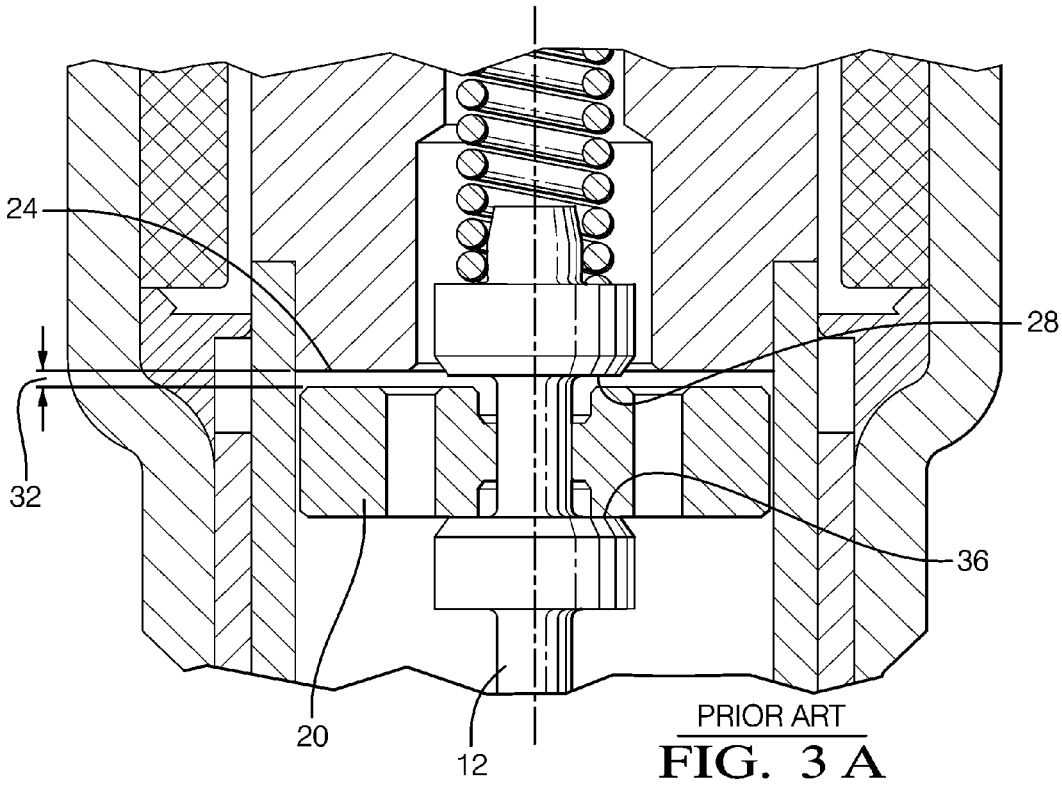
PRIOR ART FIG. 3 A
FIG. 3 is a close-up view of a prior art fuel injector.
Figure 3B:
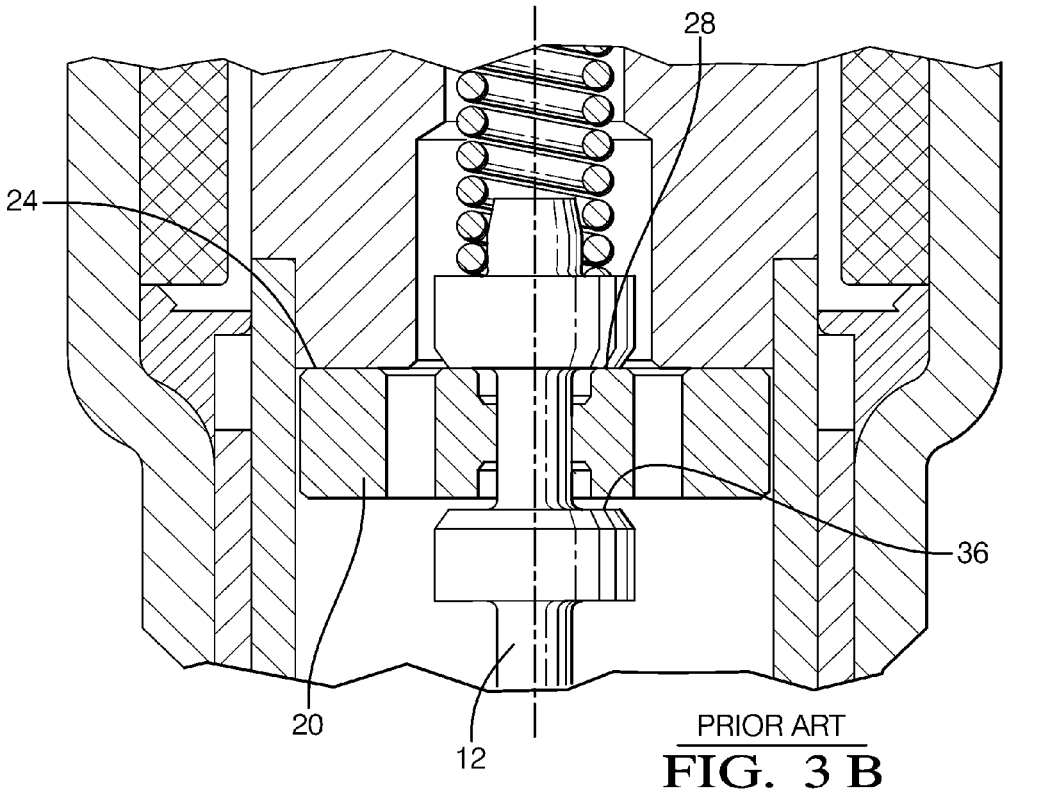
PRIOR ART FIG. 3 B

When the magnetic field is not present the pintle 12 is free to move toward the closed position, and the sliding armature 20 is separated from the pintle stop when the sliding armature contacts the housing stop 22. While the sliding armature is moving toward the housing stop 22, the sliding armature 20 has kinetic energy that must be dissipated to stop the motion of the sliding armature. FIG. 3 shows a prior art fuel injector arrangement that, instead of transferring the sliding armature kinetic energy into a housing stop 22, transfers that kinetic energy to the pintle 12 by way of a second pintle stop 36. With this arrangement, the sliding armature kinetic energy will ultimately be transferred through the ball 14 into the nozzle seat 16. It has been observed that such an arrangement can lead to reduced reliability due to accelerated wear of interface between the ball 14 and the nozzle seat 16. It has also been observed that the transfer of kinetic energy to the nozzle seat 16 may cause the pintle 12 to bounce back and momentarily lift the ball 14 so that unmetered and/or insufficiently atomized fuel 18 is dispensed by the fuel injector 10.

In one embodiment, the pintle closing force may be due solely to a fuel pressure of the fuel 18 acting on the pintle 12 and/or ball 14 to urge the pintle toward the closed position. In general, as the fuel pressure increases, the pintle closing force increases proportionately and so the force necessary to move the pintle 12 and/or ball 14 away from the closed position increases accordingly. In another embodiment, the pintle closing force may also include a spring force arising from a pintle spring 26 acting on the pintle to urge the pintle toward the closed position. It will be appreciated that for some pintle/ball/seat configurations the spring load of the pintle spring 26 may also need to increase as the fuel pressure increases to prevent leakage of the fuel 18 from within the fuel injector 10. Also, the spring rate may be increased if a faster injector closing time is desired or if different spray performance is desired. In general, operating fuel pressures continues to move in the direction of higher pressures to improve spray atomization and practical flow range, and this may exacerbate pintle bounce.

In one embodiment, the fuel injector 10 may include an armature spring 44 configured to urge the sliding armature 20 toward the housing stop 22. Including the armature spring is advantageous in that it assures that the sliding armature 20 is as far away from the pintle stop 28 when coil current to coil 40 is applied so that the sliding armature 20 as much distance as possible to accelerate before contacting the pintle stop 28. The spring rate and preload of the armature spring 44 is selected by considering several aspects of desired fuel injector operating characteristics such as injector opening speed and vibration induced by the injector installation.

Accordingly, a fuel injector 10 capable of operating at higher fuel pressures and avoiding dispensing of unwanted or under-atomized fuel during an injector closing event is provided. The sliding armature 20 enables the fuel injector to be opened at higher fuel pressures without resorting to a larger injector assembly and/or higher coil currents. When the fuel injector 10 is attached to an internal combustion engine such as an automobile engine, kinetic energy present in the sliding armature 20 when the sliding armature is moving to allow the pintle 12 to move to the closed position is transferred through the housing 30 into the engine block or fuel injector mounting apparatus instead of being transferred to the nozzle seat 16 as is the case for some prior art configurations. Durability testing of fuel injectors having key features similar to those shown in FIGS. 1-2 has indicated that both the Dynamic Flow Shift and Static Flow Shift induced by a durability test is reduced by about 50% when compared to fuel injectors having key features similar to those shown in FIG. 3. Dynamic Flow Shift is a measure of shift in fuel quantity delivered by an injector following a durability test when the injector is operated in a manner similar to what is expected when the injector is operating on an engine. Static Flow Shift is a measure of shift in fuel delivery rate following a durability test when the injector is held in the open state. Subsequent teardown of tested injectors exhibit wear characteristics consistent with the flow shifts.

While this invention has been described in terms of the preferred embodiments thereof, it is not intended to be so limited, but rather only to the extent set forth in the claims that follow.

We claim:

1. A fuel injector comprising:

a housing configured to direct fuel flow therethrough;

a nozzle seat fixedly coupled to the housing and configured to direct fuel flow from the fuel injector;

a pintle arranged within the housing, said pintle movable in an inward direction characterized as toward the center of the housing to an open position where the pintle is spaced apart from the nozzle seat such that fuel is dispensed by the fuel injector and movable in an outward direction characterized as away from the center of the housing to a closed position where the pintle contacts the nozzle seat such that no fuel is dispensed by the fuel injector, wherein said direction of movement of said pintle is characteristic of an inward opening fuel injector;

a pintle stop fixedly coupled to the pintle;

a housing stop fixedly coupled to the housing;

a sliding armature movable between the pintle stop and the housing stop in response to a magnetic field, wherein when the magnetic field is present the sliding armature contacts the pintle stop and urges the pintle toward the open position, when the magnetic field is not present the pintle is free to move toward the closed position, and the sliding armature is separated from the pintle stop when the pintle contacts the nozzle, and continues to move until the sliding armature contacts the housing stop.

2. The fuel injector in accordance with claim 1, wherein the fuel injector further comprises a pintle spring configured to urge the pintle toward the closed position.

3. The fuel injector in accordance with claim 1, wherein the fuel injector further comprises an armature spring configured to urge the sliding armature toward the housing stop.

* * * * *